United States Patent [19]

Saad

[11] Patent Number: 4,991,642

[45] Date of Patent: Feb. 12, 1991

[54] FLUORINE-FREE MOLD POWDERS

[75] Inventor: Elie E. Saad, Silver Springs, Md.

[73] Assignee: Stollberg, Inc., Niagara Falls, N.Y.

[21] Appl. No.: 394,783

[22] Filed: Aug. 16, 1989

Related U.S. Application Data

[62] Division of Ser. No. 307,666, Feb. 6, 1989, Pat. No. 4,880,463.

[51] Int. Cl.[5] ..... B22D 11/07; B22D 11/10

[52] U.S. Cl. ..... 164/472; 164/473

[58] Field of Search ..... 164/472, 473; 75/53, 75/58, 257

[56] References Cited

U.S. PATENT DOCUMENTS 3,649,249 3/1972 Halley et al. ..... 75/96
3,899,324 8/1975 Corbett ..... 75/94
4,092,159 5/1978 Uher ..... 75/257
4,204,864 5/1980 Loane et al. ..... 75/257

*Primary Examiner*—Kuang Y. Lin
*Attorney, Agent, or Firm*—Edwin T. Bean, Jr.; Martin G. Linihan; John C. Thompson

[57] ABSTRACT

A glass frit composition having the theoretical oxide values (in weight %) of 0.5–9 $Li_2O$, 29–38 $Na_2O$, 0–25 CaO, 5–10 $B_2O_3$ and 38–50 of $SiO_2$ is characterized in that it is virtually fluorine-free and was found to be eminently suitable in its molten form as a lubricant in the continuous casting of steel. The invention is thus related to a lithium containing fluorine-free frit compositions and in a second aspect to an improvement in the process for the continuous casting of steel, the improvement comprising using as a lubricant the glass frit composition referred to above.

6 Claims, No Drawings

FLUORINE-FREE MOLD POWDERS

This application is a division of application Ser. No. 07/307,666 filed Feb. 6, 1989, now U.S. Pat. No. 4,880,463.

FIELD OF THE INVENTION

The invention relates to a glass frit composition and more particularly to frit useful as a lubricant in the continuous casting of steel.

1. Summary of the Invention

A glass frit composition having the theoretical oxide values (in weight %) of 0.5–9 $Li_2O$, 29–38 $Na_2O$, 0–25 CaO, 5–10 $B_2O_3$ and 38–50 of $SiO_2$ characterized in that it is virtually fluorine free was found to be eminently suitable in its molten form as a lubricant in the continuous casting of steel. In a second aspect the invention relates to an improvement in the process for the continuous casting of steel, the improvement comprising using as a lubricant, the glass frit composition referred to above.

2. Background of the Invention

In the continuous casting of steel it was found that improved results are obtained by providing on the upper surface of the molten steel a protective layer of synthetic slag. The term "slag" and the term "flux" have often been used interchangeably in this context for fritted or predominantly fritted mold powders for continuous casting purposes. In the present context, a particulate slagging composition will be defined as encompassing all types of materials used to protect and lubricate steel during the continuous casting process. In the present context, mold powders are essentially raw materials which have not been vitrified to any appreciable extent.

The relevant art is noted to include U.S. Pat. No. 3,649,249 which disclosed a synthetic slag forming composition for use in a continuous casting process. A fluorine containing flux composition in the form of frit particles has also been disclosed in U.S. Pat. No. 3,899,324. The presence of fluorine was long recognized to have an undesirable effect on the linings of smelters. A chemical attack generally manifests itself by the dissolution of the brick lining which makes repair work necessary. Additionally, volatilized fluorides need to be recovered due to environmental considerations. A solution to the problem associated with the inclusion of fluorine in raw materials of frit compositions was presented in U.S. Pat. No. 4,092,159. The invention entailed smelting vitrifiable raw materials for the preparation of a frit containing a limited amount of fluorine and blending the frit with a fluorine providing material in the form of discreet unvitrified particles.

In U.S. Pat. No. 4,204,864 there was disclosed a particulate slagging composition useful in the continuous casting of steel which is characterized in the absence of lithium therefrom.

It is an object of the invention to provide a particulate slagging composition suitable for use in the continuous casting of steel. Further, it is an object of the invention to provide a particulate slagging composition which is fluorine free. It is also an object of the invention to provide a particulate slagging composition which due to its rheology and chemistry is an excellent lubricant in the context of the continuous casting of steel.

DETAILED DESCRIPTION OF THE INVENTION

In accordance with the invention there is provided a particulate slagging composition of glass network formers and fluxing agents therefor which composition is characterized in that it contains lithium and in that it is virtually fluorine free. Owing to its rheological properties the molten components is eminently suitable as a lubricant in the continuous casting of steel. The theoretical oxide content of the composition (in weight %) is as follows:

| | |
|---|---|
| $Li_2O$ | 0.5–9 |
| $Na_2O$ | 29–38 |
| CaO | 0–25 |
| $B_2O_3$ | 5–10 |
| $SiO_2$ | 38–50 |

preferably the oxide content is

| | |
|---|---|
| $Li_2O$ | 1–7 |
| $Na_2O$ | 29–35 |
| CaO | 10–25 |
| $B_2O_3$ | 5–8 |
| $SiO_2$ | 38–50 |

Sodium oxide may be replaced wholly or partially by potassium oxide.

In its molten state, the composition of the invention is characterized in that its viscosity at 2600° F.—measured in accordance with the procedure recognized in the art as Herty—is about 5 to 9 inches, in that its softening temperature is about 870 to 960° C. and that its melting temperature is about 910–980° C.

The composition of the invention may be prepared in a smelter. Molten glass from the smelter is conventionally fritted by allowing a stream of the glass into water or by fracturing it subsequently to its passage between chilled rolls. The resulting frit is preferably milled to a particle size finer than 150 mesh for use in continuous casting.

The raw materials for preparing the composition of the invention are usually in the form of minerals and chemicals of purity satisfactory for glass-making. It is important, however, to make certain that the composition of the invention contains no fluorine. That is to say that fluorospar, cryolite and fluorides may not be used as raw materials for the preparation of the composition of the invention.

The Herty viscosity which characterizes the composition of the invention is determinable by a method well known in the art. The method is set out, for instance, in U.S. Pat. No. 3,649,249 which is incorporated herein by reference. Essentially, the "flowidity" as the property is termed there is a distance in inches which the slag composition flows through a conduit before solidifying when 200 grams of the prefused slag at a temperature of 2600° F. is rapidly poured into a conical recess. The pouring technique and time of the test procedure are standardized to obtain consistent results. The temperature of the mold within normal operating limits has little effect on the measured property.

The softening temperature and melting temperature of the composition of the invention may be determined by methods long known in the art.

The invention is further illustrated but is not intended to be limited by the following examples in which all parts and percentages are by weight unless otherwise specified.

EXAMPLES

Example 1

Frit was prepared by conventionally dry mixing, fusing and water quenching raw materials to yield a frit of the following theoretical analysis:

| | |
|---|---|
| $Li_2O$ | 7.98 |
| $Na_2O$ | 34.08 |
| $B_2O_3$ | 8.10 |
| $SiO_2$ | 49.84 |

The composition was evaluated and its Herty was determined to be about 5 inches. The composition was regarded to be suitable as within the scope of the invention based on its softening and melting temperatures.

Example 2

Additional frit conforming to the following theoretical analyses were prepared and evaluated.

| | A | B |
|---|---|---|
| $Li_2O$ | 6.96 | 2.98 |
| $Na_2O$ | 29.44 | 31.41 |
| CaO | 19.69 | 21.67 |
| MgO | 0.54 | 0.6 |
| $B_2O_3$ | 5.07 | 5.07 |
| $SiO_2$ | 38.29 | 38.27 |

The Herty viscosity for this composition A was about 8 inches. Its softening temperature was 870° C. and its melting temperature was 900° C. The corresponding values for composition B were 6.5 inches, 950° and 980° C. respectively.

The presence of the small amount of MgO is not believed to be critical or necessary in the composition of the invention.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A method of protecting molten steel during a process for the continuous casting of steel wherein a pool of molten steel is maintained in the upper end of an open ended continuous casting mold, the method comprising forming on the top of said pool a protective layer of a fluorine-free particulate slagging composition having the theoretical approximate oxide analysis of:

| | |
|---|---|
| $Li_2O$ | 0.5-9 |
| $Na_2O$ | 29-38 |
| CaO | 0-25 |
| $B_2O_3$ | 5-10 |
| $SiO_2$ | 38-50. |

2. The method of claim 1 wherein said $Na_2O$ is at least partially replaced by $K_2O$.

3. A method of lubricating molten steel during a process for the continuous casting of steel, the method comprising using as a lubricant in said process a fluorine-free particulate slagging composition having the theoretical approximate oxide analysis of:

| | |
|---|---|
| $Li_2O$ | 0.5-9 |
| $Na_2O$ | 29-38 |
| CaO | 0-25 |
| $B_2O_3$ | 5-10 |
| $SiO_2$ | 38-50. |

4. The method of claim 3 wherein said $Na_2O$ is at least partially replaced by $K_2O$.

5. A method of protecting and lubricating molten steel during a process for the continuous casting of steel comprising introducing to the molten steel a fluorine-free particulate slagging composition having the theoretical approximate oxide analysis of:

| | |
|---|---|
| $Li_2O$ | 0.5-9 |
| $Na_2O$ | 29-38 |
| CaO | 0-25 |
| $B_2O_3$ | 5-10 |
| $SiO_2$ | 38-50. |

6. The method according to claim 5 wherein said $Na_2O$ is at least partially replaced by $K_2O$.

* * * * *